United States Patent [19]

Kranz

[11] 3,946,938

[45] Mar. 30, 1976

[54] TWO PIECE MAILER

[75] Inventor: Richard Kranz, Prairie Village, Kans.

[73] Assignee: Tension Envelope Corporation, Kansas City, Mo.

[22] Filed: Sept. 18, 1974

[21] Appl. No.: 506,960

[52] U.S. Cl. ..... 229/73; 229/92.7

[51] Int. Cl.[2] ..... B65D 27/06

[58] Field of Search ..... 229/92.7, 72, 73, 92.1, 229/92.3

[56] References Cited

UNITED STATES PATENTS 743,317 11/1903 Naugle ..... 229/72

2,928,583 3/1960 Law ..... 229/73

*Primary Examiner*—William Price
*Assistant Examiner*—Stephen P. Garbe
*Attorney, Agent, or Firm*—Fishburn, Gold & Litman

[57] ABSTRACT

A multiple piece envelope arrangement is made from a single blank folded so that seal gum may be applied simultaneously upon the adjacent sealing flaps of separable pieces, thereby substantially reducing the cost of production.

3 Claims, 9 Drawing Figures

TWO PIECE MAILER

This invention relates to envelopes and more particularly to an envelope configuration which permits the efficient and rapid production of a two-piece mailer, or the like.

In mailing packets of advertising materials or the like to recipients, return envelopes are often enclosed as an incentive to respond. In some instances, more than one return envelope is needed, however, this is not only expensive but makes the packet unnecessarily thick and may increase required postage. This invention is directed to a multiple piece mailer which may be easily and simply manufactured on conventional envelope folding equipment for separation into two or more return pieces. Also, if desired, the configuration herein described may be used in the manner of a two-way mailing envelope generally of the type described in U.S. Pat. No. 1,089,486.

In the practice of this invention, a relatively simple blank configuration is so folded that seal flaps of separable mailing pieces project into adjacent but staggered, or squamoid, formation whereby seal gum may be applied in a continuous strip in the manner often used for producing conventional envelopes. Expensive and time consuming additional production steps are thereby avoided.

The principal objects of the present invention are: to provide a two-piece mailer which is produced from a simple blank configuration; to provide a multiple envelope arrangement which is easily manufactured in a single pass through conventional envelope folding equipment; to provide an envelope configuration which is separable along a predetermined tear line to produce multiple envelopes or similar structures; to provide such a configuration which is useful as multiple return mailers and folders suitable for enclosure with advertising mail packets; and to provide such a folded configuration which is inexpensive and well adapted for its intended purpose.

Other objects and advantages of this invention will become apparent from the following description taken in connection with the accompanying drawings wherein are set forth by way of illustration and example, certain embodiments of this invention.

FIG. 4 is a plan view similar to FIG. 2 but showing the blank after side flaps have been turned in.

Figure 1:
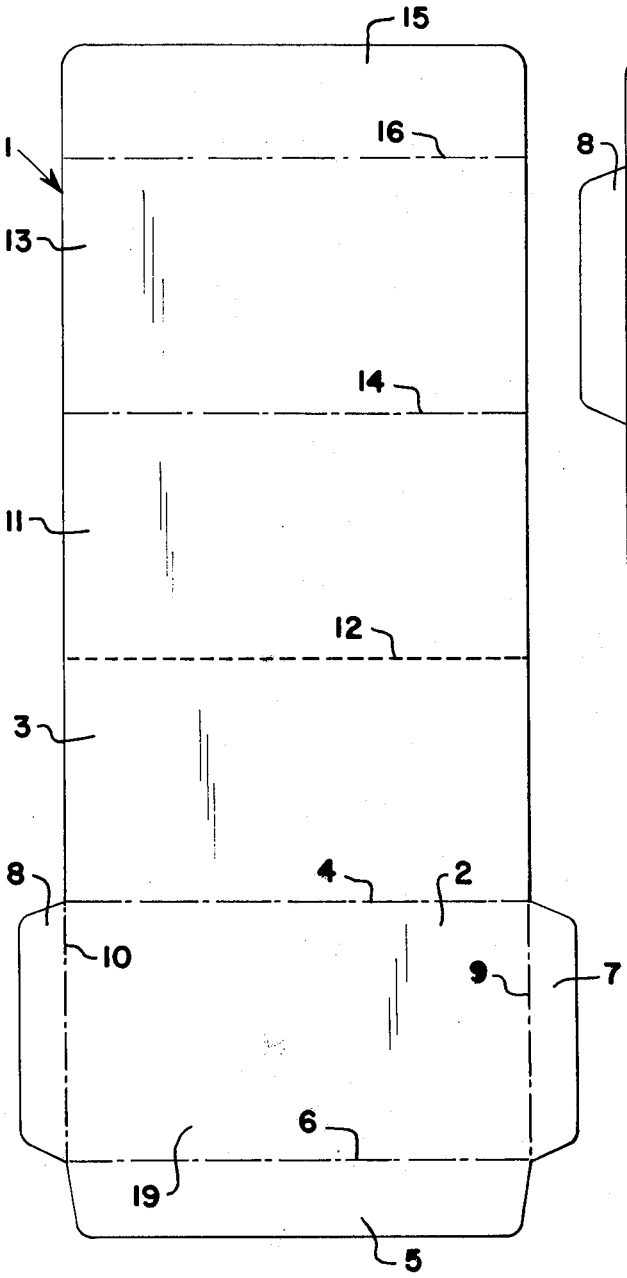
FIG. 1 is a plan view showing a typical blank utilized in the practice of this invention.

Referring to the drawings in more detail:

The reference numeral 1 (FIG. 1) generally indicates an envelope blank utilized in the practice of this invention. The blank 1 comprises a first panel 2 and a second panel 3 attached to each other along a first fold line 4. A first seal flap 5 is attached to the first panel 2 along a fold line 6 and is directed in opposed relation to the second panel 3. Suitable side flaps 7 and 8 project transversely or laterally from the first panel 2 along respective fold lines 9 and 10. A third panel 11 is attached to the panel 3, in this example, along a tear line 12 and is opposed to the panel 2. A fourth panel 13 is attached to the third panel 11 along a fold line 14 opposed to the tear line 12. Finally, a second seal flap 15 of greater depth than the first seal flap 5, is attached to the fourth panel 13 along a fold line 16 opposed to the fold line 14.

The noted fold lines are preferably produced by scoring in the conventional manner during passage of the blank through the envelope machine and are positioned to produce the structure as described. Likewise, the tear line 12 is preferably produced in the known manner by forming a line of preforations or weakening slots in the blank during travel through the machine. However, both the scoring and tear line production may be accomplished as separate steps prior to feeding into the folding machine, if desired.

Figure 2:
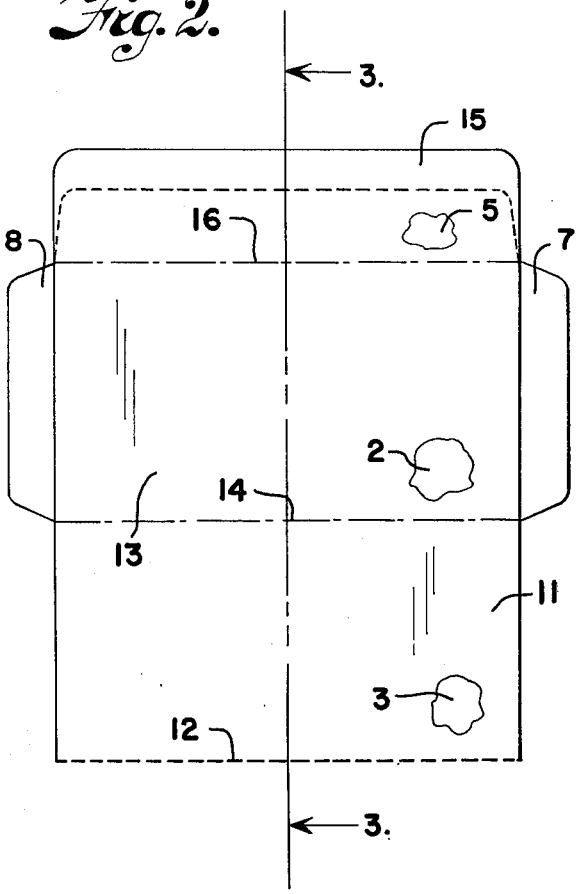
FIG. 2 is a plan view showing the blank of FIG. 1 partially folded during manufacture.
Figure 3:
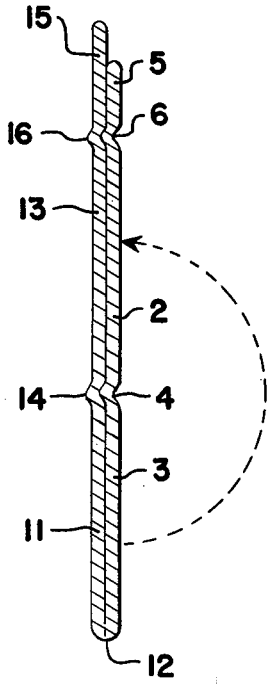
FIG. 3 is a cross-sectional view taken along the line 3—3, FIG. 2, and greatly exaggerated in material thickness for clarity of illustration.
Figure 4:
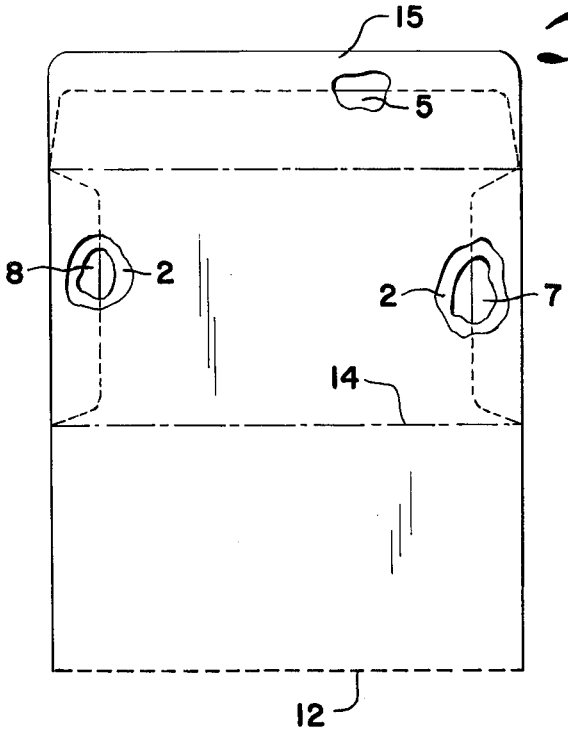

In producing a two-piece mailer embodying this invention various scoring, folding and adhesive application sequences are possible, however, in a preferred sequence the blank portion comprising the panels 3 and 2, with attached flaps, 5, 7 and 8, is first folded about the previously formed tear line 12, producing a configuration shown in FIGS. 2 and 3. In the folded configuration of FIG. 3, the fold lines 16 and 6, applied either previously or subsequently to folding about the line 12, overlap and substantially coincide in the upper blank area and the fold lines 14 and 4, similarly applied, overlap and substantially coincide therebelow. The side flaps 7 and 8 are folded inwardly over the panel 2 in the usual manner and gummed just prior to again folding the doubled blank, in this instance counter-clockwise as seen in FIG. 3, about the fold lines 14 and 4, producing the configuration shown in FIG. 5. This forms an envelope pocket 17 between the panels 2 and 3 with the flap 5 projecting upwardly therefrom as viewed in FIGS. 5 and 6. In this configuration, the panel 2 has an inside surface 18 facing the panel 3 and an outside surface 19 facing oppositely or away from the panel 3, FIG. 5 and the relative size of the respective panels and positions of the various fold lines are such that the tear line 12 and the first flap fold line 6 are generally overlapping in position and respecively define the mouth of the pocket 17. The closure flap 5 has an inside surface 20 directed or exposed toward the pocket 17, as best illustrated in FIG. 5.

Figure 5:
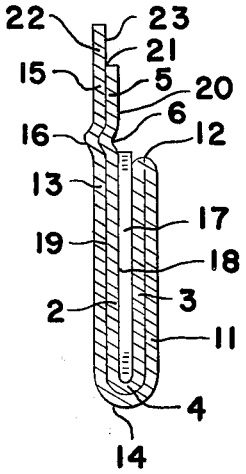
FIG. 5 is a cross-sectional view similar to FIG. 3 but showing the blank after the side flaps are turned in and a further fold has occurred whereby seal flaps of adjacent envelope parts extend in squamoid relation.
Figure 6:
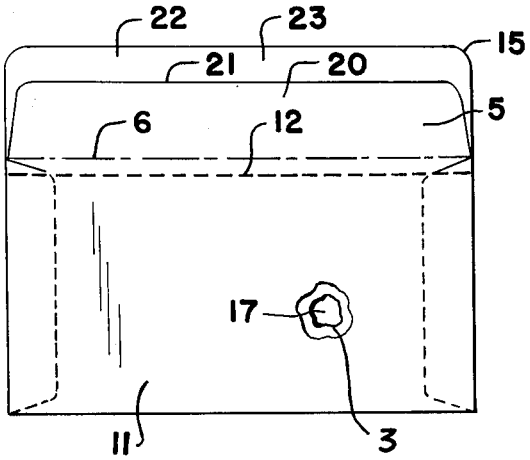
FIG. 6 is a plan view showing the blank in the configuration of FIG. 5.
Figure 8:
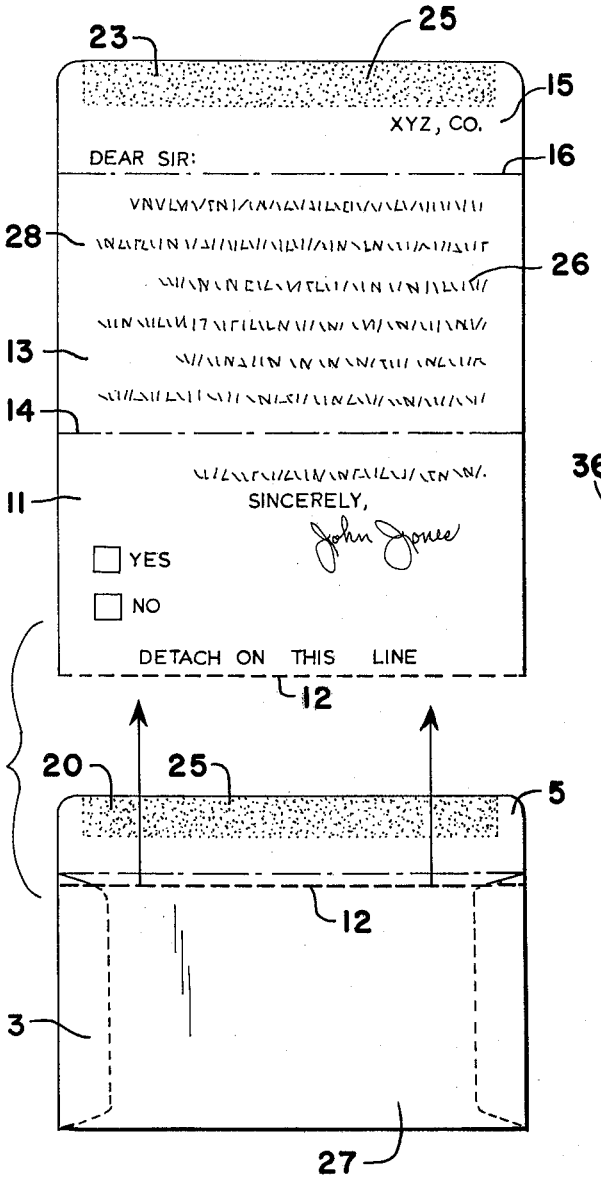
FIG. 8 is a plan view illustrating the separation of a completed mailer into two mailing pieces.

Further referring to FIG. 5, in the illustrated configuration the fold line 4 forms a closed bottom for the envelope pocket 17 and the fourth panel 13 assumes a position against the outside surface 19 of the first panel 2. Also, the second seal flap 15 extends upwardly beyond the first flap 5 at 21 and the portion 22 of the second closure flap 15, which extends beyond the first closure flap 5, presents an inside surface 23 exposed or directed toward the pocket 17 and generally comprising a surface extension of the first flap inside surface 20.

Figure 7:
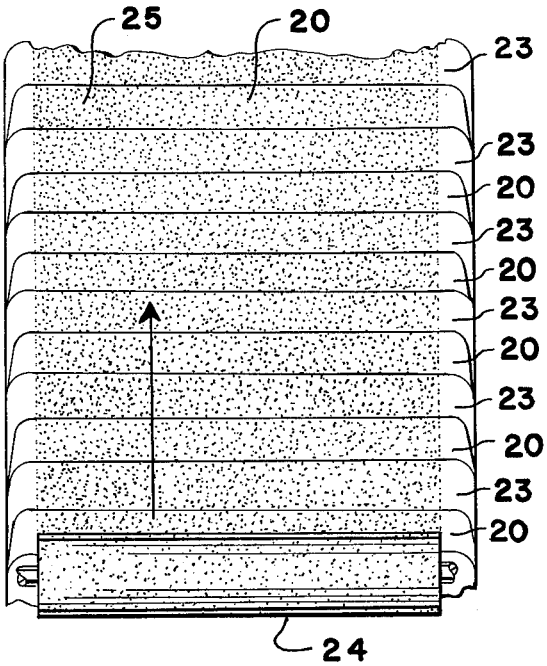
FIG. 7 is a fragmentary plan view showing a continuous line of folded blanks with squamoid positioned seal flaps as they appear in an envelope folding machine during manufacture.

The above described folding steps and, if desired, tear and fold line applications are easily performed during a single pass through conventional high-speed envelope folding machines such as a Winkler and Dunnebier Mark IV GS or 26G. Likewise, further series of operations easily performed on conventional envelope equipment during the same pass includes the relative slowing of blank speed, causing an overlapping or squamoid positioning, such as illustrated in FIG. 7, wherein the respective flap surfaces 23 and 20 appear as alternate steps in a continuous path of exposed flap surfaces. In this configuration, a suitable cylindrical (continuous surface) adhesive application roller 24 may be utilized to continuously apply a selected adhesive 25 in a path having a width corresponding to the distance between the ends of the roller 24. The respective folded envelopes may then be fanned out further in a conventional manner and passed through a suitable drying chamber to permit further operations such as folding down the seal flaps 5 and 15 over the third panel 11, if desired. Appropriate means, such as a stream of air may be utilized to partially separate first and second flaps during drying to insure that they do not become secured together. Also, conventional adhesive form applicators, or pickers, may be used to apply the adhesive on the first and second flaps in initially separated patterns. Printing may be applied at several points during travel through the machine and/or prior and/or subsequent to completion.

Assuming receipt of the combination envelopes in folded condition, the recipient unfolds same revealing printing 26. Further, action normally involves separation of the panels 11, 13 and flap 15 from the remainder or envelope 27 along the tear line 12, producing two separate envelopes, or more accurately, an envelope 27 and a sealable folder 28, which may be respectively utilized for separate return purposes. As illustrated, the envelope or folder 27 is used by folding or refolding the flap 5 over the second panel 3 and securing same by dampening (in the case of water actuating adhesive) the portion of the adhesive 25 which was applied to the surface 20. The folder 28 is utilized as a separate mailing piece by folding the panels 11 and 13 along the fold line 14, folding the seal flap 15 along the fold line 16 and sealing with the adhesive 25 which was applied to the surface 23.

Figure 9:
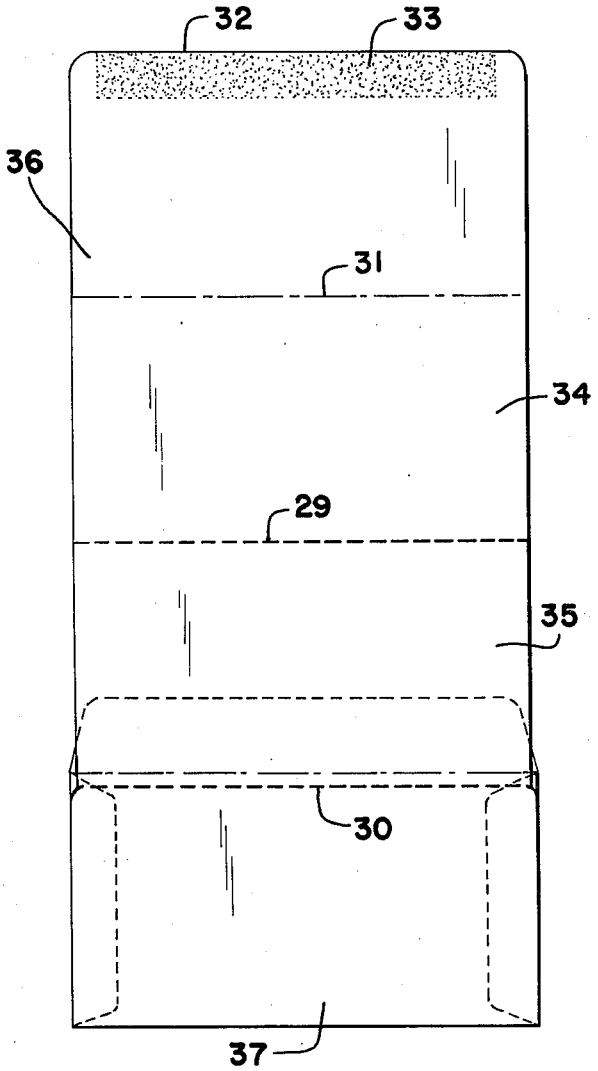
FIG. 9 illustrates a completed, but partially unfolded, modified form of mailer embodying this invention.

Several variations of the noted structure may now be apparent to those skilled in the art, for example, the modified configuration shown in FIG. 9 wherein a second tear line 29 is spaced above the pocket tear line 30 and the portions projecting above the line 30 are somewhat narrower in width than the first described embodiment. In this modified form a fold line 31 may be centered between the upper edge 30 of the extending portion and the tear line 29 so that, upon folding along the line 31 the adhesive 33 may be used to secure the folded piece together adjacent the tear line 29 on the panel 34. The panel 35 between the tear lines 29 and 30 may then be utilized as a separate document, free from both the folder 36 and envelope 37. The narrower width permits the panel 35 to be easily inserted in the envelope 37, if indicated.

If desired, the flap 15 may be elongated beyond side edges of the panel 13 (as seen in FIG. 1) producing lateral ears (not shown) which could be utilized to at least partially seal otherwise open ends of the folder 28 by folding and sealing after closure. Adhesive application to the ears during manufacture could be accomplished simultaneously with application to the flap 15.

It is to be understood that while certain forms of this invention have been illustrated and described, it is not to be limited thereto except insofar such limitations are included in the following claims.

What I claim and desire to secure by Letters Patent is:

1. A multiple piece mailer comprising:

a. an envelope having first and second panels attached to each other along a first fold line and respectively folded along said first fold line against one another to define a pocket, said first panel having an inside surface facing said second panel and an outside surface facing away from said second panel, said second panel having a perforated fold line spaced from said first fold line, b. said first panel having a portion extending beyond said pocket forming a closure flap for said pocket, said pocket closure flap having an inside surface exposed toward said pocket, c. a third panel attached to said second panel along said perforated fold line and folded along said perforated fold line against said second panel and along said pocket, d. a fourth panel attached to said third panel along a second fold line and folded along said second fold line against said first panel outside surface, said first and second fold lines being in juxtaposed relationship with each other, said fourth panel having a portion extending beyond said pocket closure flap and forming a folder closure flap, said folder closure flap having an inside surface exposed toward said pocket and adjacent said pocket closure flap inside surface, and e. seal adhesive on said folder closure flap inside surface and pocket closure flap inside surface, f. the length of each of the second and third panels measured from the perforated fold line toward the second fold line being substantially equal and the length of each of the first and fourth panels measured from the closure flaps toward the second fold line being substantially equal.

2. The mailer as set forth in claim 1 wherein:

a. said second fold line is a perforated line.

3. The mailer as set forth in claim 1 wherein:

a. said seal adhesive is continuous along said inside surfaces.

* * * * *